US006425335B1

(12) United States Patent
Chen

(10) Patent No.: US 6,425,335 B1
(45) Date of Patent: Jul. 30, 2002

(54) MINIATURE GARBAGE INCINERATOR

(76) Inventor: Ying-Tsung Chen, P.O. Box 697, Feng-Yuan City 420 (TW)

( * ) Notice: Subject to any disclaimer, the term of this patent is extended or adjusted under 35 U.S.C. 154(b) by 0 days.

(21) Appl. No.: 09/886,925

(22) Filed: Jun. 20, 2001

(51) Int. Cl.[7] ..... F23B 7/00; F23G 5/00

(52) U.S. Cl. ..... 110/235; 110/233; 110/241; 110/255; 110/258

(58) Field of Search ..... 110/233, 235, 110/240, 255, 258, 342, 346, 241, 110

(56) References Cited

U.S. PATENT DOCUMENTS 3,557,724 A * 1/1971 Pan ..... 110/8
3,824,935 A * 7/1974 Yamato ..... 110/13
4,017,254 A * 4/1977 Jones ..... 432/72
4,043,280 A * 8/1977 Wray et al. ..... 110/7 R
4,261,269 A * 4/1981 Mallek et al. ..... 110/251
4,574,712 A * 3/1986 David ..... 110/288
5,735,224 A * 4/1998 Takasuka et al. ..... 110/259

* cited by examiner

*Primary Examiner*—Ira S. Lazarus
*Assistant Examiner*—K. B. Rinehart

(57) ABSTRACT

A miniature garbage incinerator includes a base, a cover on the base, a pot shaped furnace at the center of the base to define an revolving space therearound, a helical pipe connected to the air revolving space and heat source in the bottom of the base for providing whirlpool flame around the furnace, a motor on the central top of the cover to actuate a stirring rod inside the incinerator, an inlet including a spiral propeller tube in a side wall of the cover for feeding the garbage and filthy mud into the furnace, a heat revolving pipe including a blower connected between a top of the cover and a lateral wall of the base, a chimney connected to a lateral wall opposite to the heat revolving pipe, a pressure adjustment valve on a top of the cover and an ashes collector under the chimney connected to the bottom of the furnace through an ashes spiral propeller tube. The miniature garbage incinerator can be used individually or combined with a filthy mud furnace and a heat stove.

2 Claims, 6 Drawing Sheets

MINIATURE GARBAGE INCINERATOR

BACKGROUND OF THE INVENTION

The present invention relates to incinerator and more particularly to a miniature garbage incinerator which can dispose the wastes and filthy mud synchronously.

Typical miniature garbage incinerator (as shown in FIG. 1) comprises a main incinerator 10 and a filthy mud furnace 16. The main incinerator 10 has a motor 13 for controlling a sliding door 11 where is the inlet of the incinerator 10, a burner in the lower portion 12, a guide pipe 14 at a top communicating to the filthy mud furnace 16 which has an inlet 18 for the entrance of the filthy mud into the furnace 16 and a motor 17 operating a shaft 19 for stirring the filthy mud inside the furnace to be quickly dried up. When ignite the burner, the fire burns the wastes inside the main incinerator 10 and the superfluous heat enter into the furnace 16 via the guide pipe 14 to heat the filthy mud which under the stirring of the shaft 19 will be dried up into ashes. However, this type of garbage incinerator wastes a great deal of energy and would not completely dry up the mud but causes environmental contaminant.

SUMMARY OF THE PRESENT INVENTION

The present invention has a main object to provide a miniature garbage incinerator which uses helical air current to build up a whirlpool heat circulation inside the incinerator in order to effectively burn up the wastes and synchronously dry up the filthy mud into ashes.

According, the miniature garbage incinerator of the present invention comprises a base, a cover on the top of the base, a pot shaped furnace disposed in the center of the base to define a flame circulation space therearound, a helical pipe communicating to the bottom of the base and a fire source for supplying whirlpool flame into the flame circulation space to burn the wastes and filthy mud inside the furnace, a motor on the central top of the cover for actuating a rotatable rods in the center of the incinerator having a length reached the bottom of the pot shaped furnace, a transverse rod across the cover having a bearing at center to wrap the rotatable rods, a plurality of stirring rod spacedly and perpendicularly connected the lower portion of the rotatable rods, a heat revolving pipe including a blower connected between the cover and the base for leading the heat from the cover back into the base, an inlet at a lateral side of the cover including a spiral propeller tube for feeding the garbage and filthy mud into the furnace, a chimney communicated with the flame circulation space for exhausting the smoke out of the flame circulation space, an ashes collector at a lateral side of the base having spiral propeller tube connected to the furnace for collecting the ashes from the furnace, a pressure adjustment valve in a top of the cover and a pair of guide plate on the lateral sides of the base for protecting the blower and the ashes collector. The garbage incinerator can be used individually or combined with a filthy mud furnace and a heat stove in order to increase the capacity of the incinerator.

The present invention will become more fully understood by reference to the following detailed description thereof when read in conjunction with the attached drawings.

DETAILED DESCRIPTION OF TIE PREFERRED EMBODIMENT

Figure 1:
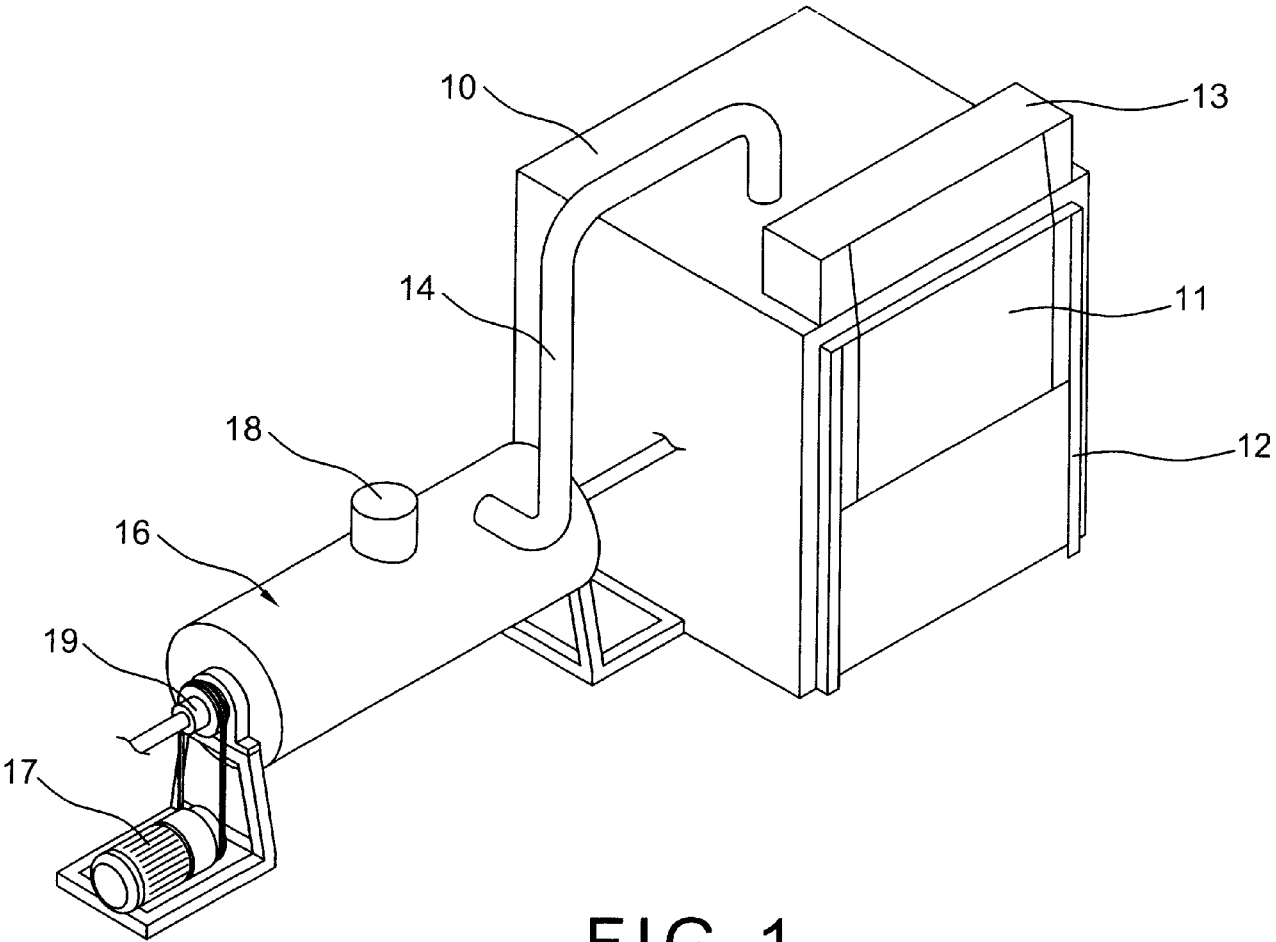
FIG. 1 Prior Art
FIG. 1 is a perspective view to show a garbage incinerator according to a prior art.
Figure 2:
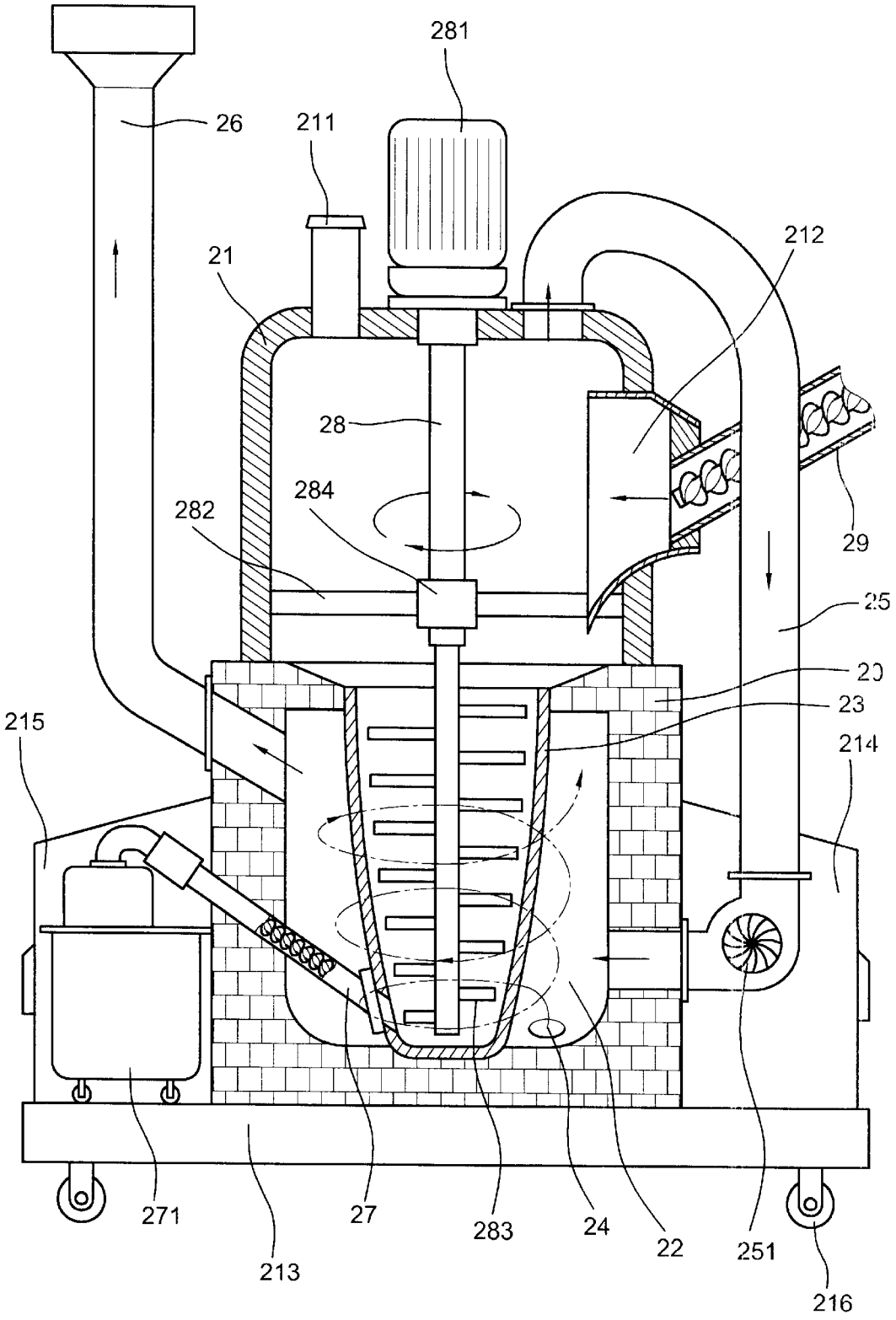
FIG. 2 is a sectional view to show a miniature garbage incinerator of the preferred embodiment according to the present invention.
Figure 3:
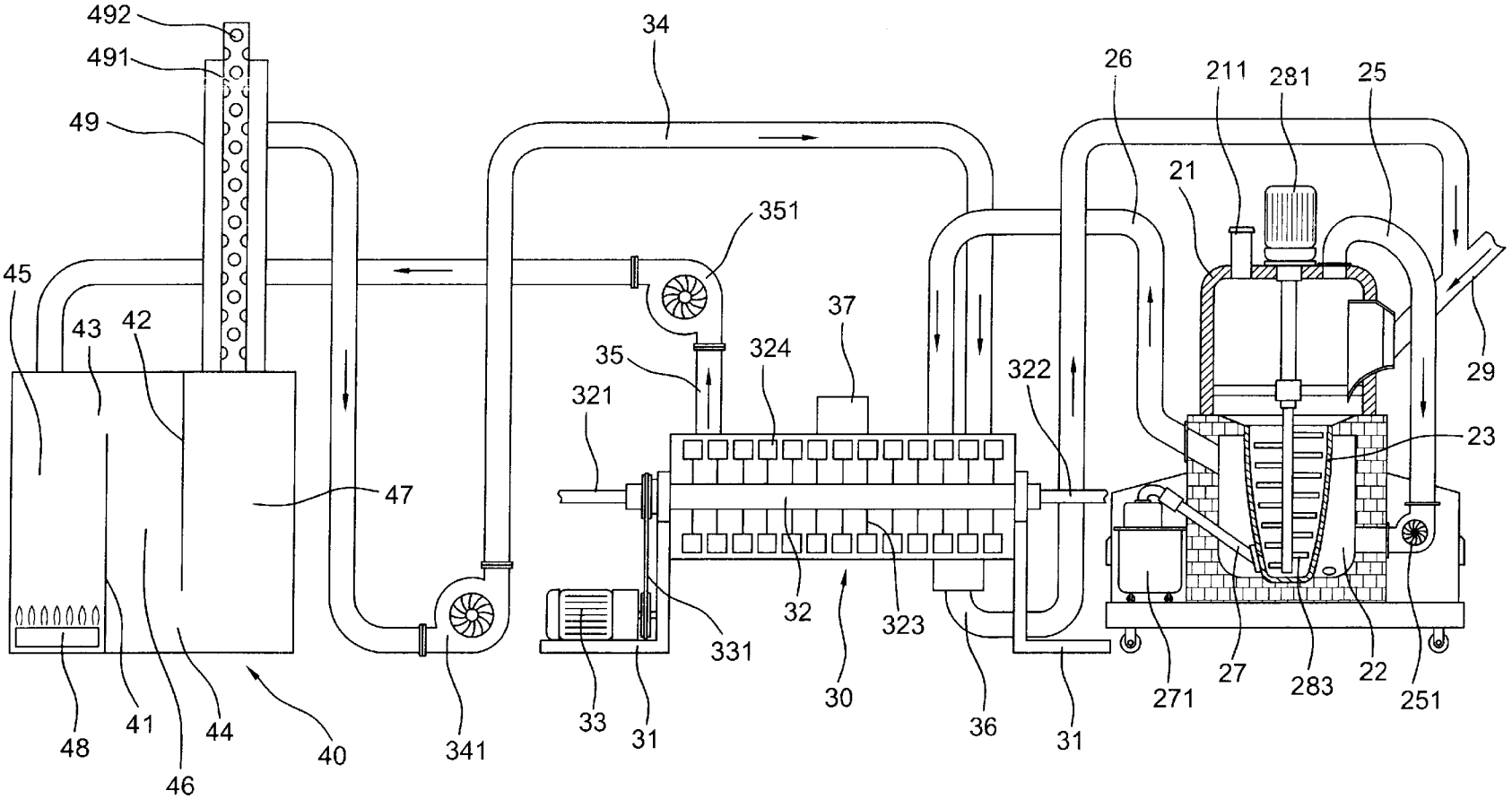
FIG. 3 is a plane view the miniature garbage incineration in combination with a filthy mud furnace and a heat stove.
Figure 4:
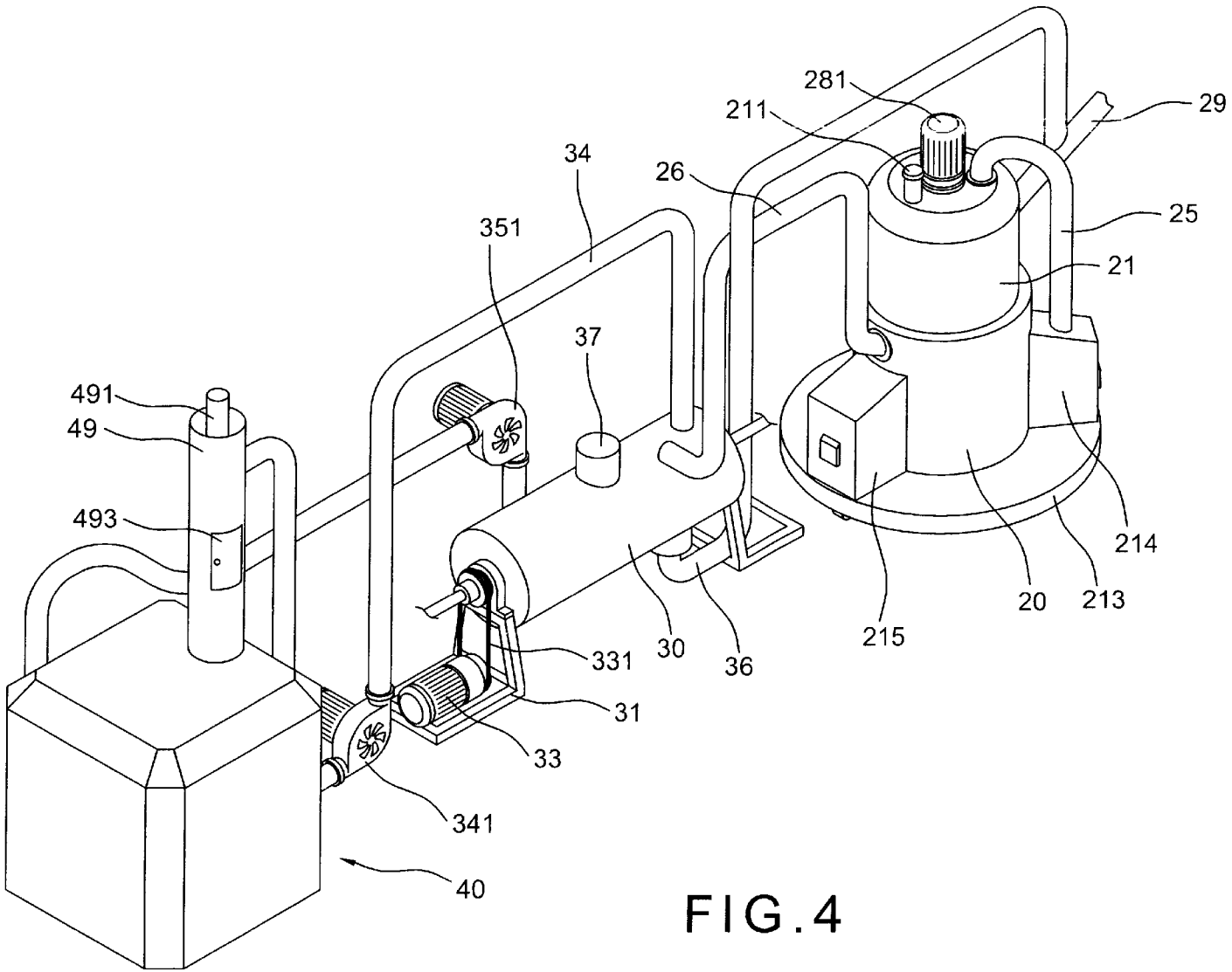
FIG. 4 is a perspective view of FIG. 3.
Figure 5:
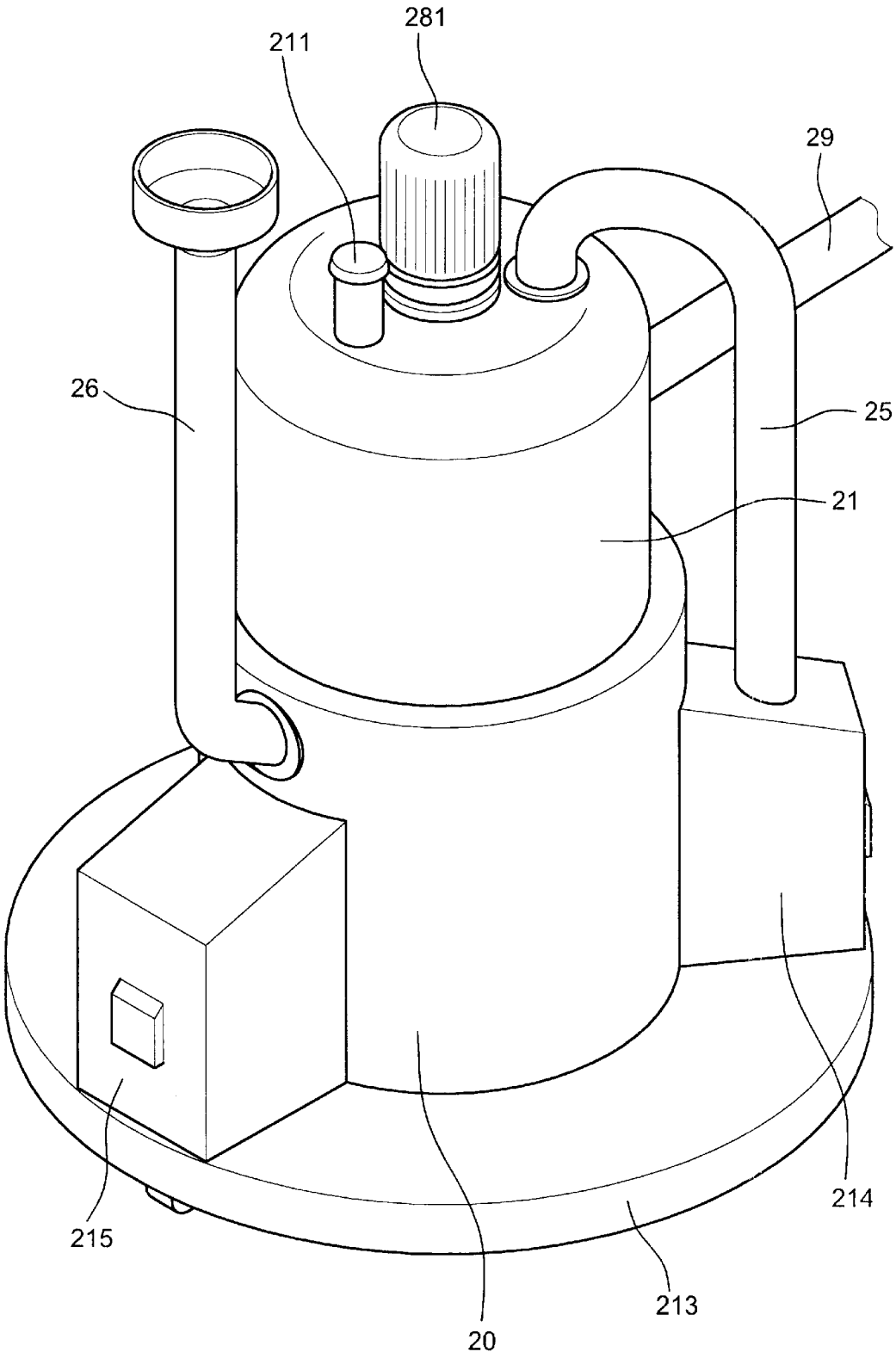
FIG. 5 is a perspective view of FIG. 2.
Figure 6:
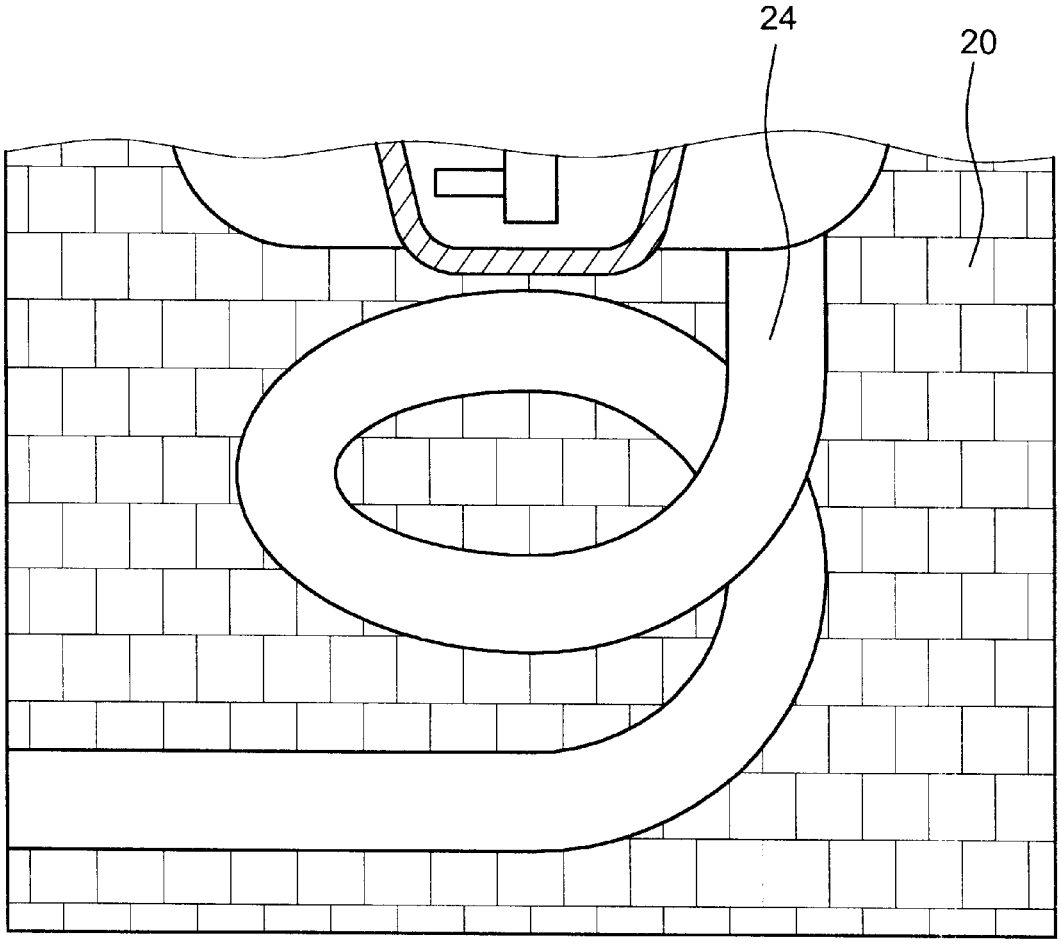
FIG. 6 is a plane view to show a helical pipe in the base of the miniature garbage incinerator.

With reference to FIGS. 2, 5 and 6 of the drawings, the miniature garbage incinerator of the present invention comprises a base 20, a cover on the top of the base 20, a pot shaped furnace 23 at the center of the base to define an air revolving space 22 therearound, a helical pipe 24 connected between the air revolving space 22 and a heat source (not shown) under the furnace 23 (as shown in FIG. 6) for providing the whirlpool flame into the air revolving space 22 and surrounding the furnace 23, a heat revolving pipe 25 including a blower 251 connected to a lower lateral wall of the base 20 and a top of the cover 21 for leading the heat from the cover 21 back to the air revolving space 22, a chimney 26 extended upward from an upper lateral wall of the base 20 communicating to the air revolving space 22, a spiral propeller tube 27 having one end connected to the lower portion of the furnace 23 and the other end connected to an ashes collector 271 outside the base 20 for collecting the ashes from the bottom of the furnace 23, a motor 281 on the central top of the cover 21 to actuate a rotatable rod 28 vertically disposed in the center of the incinerator, the rotatable rod 28 having a length reached to the bottom of the furnace 23 and supported by a transverse rod 282 and a bearing 284 at the center of the transverse rod 282, a plurality of stirring rods 283 of different lengths spaced from one another and perpendicularly connected to the lower portion of the rotatable rod 28, a conventional pressure adjustment valve 211 in a top of the cover 21 for adjusting the pressure inside the cover 21, an inlet 212 in a lateral side of the cover 21 connected to a spiral propeller tube 29 for feeding the garbage and filthy mud into the incinerator and then dropped into the furnace 23 for burning, a circular seat 213 under the base 20 having a plurality of wheels 216 thereunder for moving the incinerator from one place to another, a pair of guide shades 214 and 215 on the top of the seat for respectively protecting the blower 251 and the ashes collector 271. The above discussed structure of the miniature garbage incinerator can be used individually or combined with a filthy mud furnace 30 and a heat stove 40 which will be described as follows:

Referring to FIGS. 3 and 4 of the drawings, the filthy mud furnace 30 comprises a hollow cylindrical body supported by a pair of racks 31, a hollow shaft 32 rotatably disposed in the center of the cylindrical body actuated by a motor 33 via a chain 331 and having one end 321 for feeding the water into the shaft 32 and the other end 322 for releasing the water out of the shaft 32, a plurality of stirring rods 323 spaced from one another and perpendicularly connected to the outer periphery of the shaft each having stirring leave 324 on free end, an inlet 37 on the central top of the cylindrical body for feeding the filthy mud into the body, a lead-in pipe connected between the top of the cylindrical body and the chimney 26 of the miniature garbage incinerator, a powder releasing pipe 36 connected from the bottom of the cylindrical body to the spiral propeller tube 29 of the incinerator, a lead-in pipe 34 connected between a top of the hollow cylindrical body and a chimney 49 of the heat stove 40 with a blower 341 disposed in a corner of the pipe 34 and a heat revolving pipe 35 connected between a top of the hollow cylindrical body and a top of the heat stove 40 with a blower 351 in a corner of the pipe 35.

The heat stove 40 is of a hollow rectangular body and has a lower partition 41 and an upper partition 42 to define a first passage 43 and a second passage 44 and a first, second and third sections 45, 46 and 47, a heater 48 in the bottom of the first section under the heat revolving pipe 35 which is connected to the top of the hollow cylindrical body as described above for revolving the residual heat from the cylindrical body back to the first section and flowing into the cylindrical body again through the third section 47 of the heat stove 40 after reheating by the heater 48, the chimney 49 projected upward from the top of the third section 47 connected to the lead-in pipe 34 as described above for transporting the heat from the heat stove 40 into the cylindrical body and an inner pipe 491 inside the chimney 49 having a plurality of thru holes spaced from one another and formed in entire peripheral wall for providing the heat into the lead-in pipe 34. Partial waste gas is release from the top of the inner pipe 491. The chimney further has a door 493 on an outer periphery.

In operation, first feed the garbage and filthy mud into the incinerator through the spiral propeller tube 29 and the inlet 212 and simultaneously feed the filthy mud into the filthy mud furnace 30 through the inlet 37, secondly, turn on the motors 281 and 33 to stir the garbage and the filthy mud, thirdly, set the heat sources on fire and simultaneously turn on the blowers 251, 341 and 351 to build up several heat circulation among the incinerator, the filthy mud furnace 30 and the heat stove 40. In addition to the whirlpool flame inside the incinerator and both the heat stove 40 and the incinerator supplying the heat into the filthy mud furnace 30, the burning capacity is greatly increased. When the filthy mud inside the filthy mud furnace 30 is dried and becomes powder, it will be transported into the incinerator through the pipe 36, the spiral propeller tube 29 and the inlet 212 for further burning. After that the garbage and the filthy mud become ashes, it can be transported into the ashes collector 271 from the bottom of the pot shaped furnace through the spiral propeller tube 271 for further disposal. The specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A miniature garbage incinerator comprising:

a base having an opening in a top, a cover covering the top of the base, a pot shaped furnace disposed at a center of the base to define an air revolving space therearound, a helical pipe connected between the air revolving space and a heat source in a bottom of the base for providing a whirlpool flame into the air revolving space, a first heat revolving pipe including a first blower said pipe connecting a top of the cover and a lower lateral wall of the base for transporting the heat from the cover back to the air revolving space, a first chimney extending upward from an upper lateral wall of the base opposite to the first heat revolving pipe for release of waste gas from the base, a first spiral propeller tube connected between a lower wall of the pot shaped furnace and an ash collector positioned under the first chimney for collecting ashes from bottom of the pot shaped furnace, a first motor on a center of the top of the cover for actuating a rotatable rod which is in the center of the incinerator the rod has a length which reaches to the bottom of the pot shaped furnace, a transverse rod including a bearing at a center of the rod for connecting inner peripheries of the cover and supporting the rotatable rod, a plurality of first stirring rods of different lengths spaced and perpendicularly connected to a lower portion of the rotatable rod, a pressure adjustment valve on a top of the cover beside the first motor for adjusting the pressure inside the cover, a first inlet in a lateral side of the cover connected to a second spiral propeller tube for feeding the garbage and filthy mud into the incinerator, a circular seat under the base including a plurality of wheels on an under side of the seat for moving the incinerator from one place to another and a pair of guide shades on top of the seat for respectively protecting the first blower and the ash collector;

a filthy mud furnace combinable with the incinerator and comprising a hollow cylindrical body supported by a pair of racks, a hollow shaft rotatably disposed in the center of the cylindrical body operated by a second motor via a chain and having a water inlet at one end a water outlet at a second end, a plurality of second stirring rods spaced from one another and perpendicularly connected to an outer periphery of the shaft each having a stirring leave at a free end, a second inlet for feeding the filthy mud into the cylindrical body on a top of the body, a first lead-in pipe connected between the top of the cylindrical body and the first chimney of the incinerator and a power releasing pipe connected between a bottom of the cylindrical body and the second spiral propeller tube of the incinerator;

a heat stove combinable with the filthy mud furnace and comprising a rectangular body, a lower partition and an upper partition to define a first and a second passages and a first, second and third sections inside the rectangular body, a heater disposed on a bottom of the first section, a second chimney extending upward from a top of the third section, an inner pipe axially disposed inside the second chimney communicating with the third section and having plurality of thru holes spacedly formed in a peripheral wall, a second lead-in pipe including a second blower in a corner connected between the second chimney and the top of the filthy mud furnace and a second heat revolving pipe including a third blower in a corner connected between a top of the first section and a top of the filthy mud furnace to transport the residual heat from the filthy mud furnace back into the first section of the heat stove for reheating.

2. The miniature garbage incinerator as recited in claim 1 wherein said miniature garbage incinerator can be operated individually.

* * * * *